United States Patent [19]

Henville

[11] 4,128,157

[45] Dec. 5, 1978

[54] COIN TESTING MECHANISMS

[75] Inventor: Michael I. Henville, Wembley, England

[73] Assignee: Mars, Inc., McLean, Va.

[21] Appl. No.: 819,596

[22] Filed: Jul. 27, 1977

[30] Foreign Application Priority Data

| | | | |
|---|---|---|---|
| Jul. 28, 1976 | [GB] | United Kingdom | 31504/76 |
| Sep. 27, 1976 | [GB] | United Kingdom | 40065/76 |
| Oct. 7, 1976 | [GB] | United Kingdom | 41814/76 |

[51] Int. Cl.[2] ..... G07F 3/02

[52] U.S. Cl. ..... 194/97 R

[58] Field of Search ..... 194/97 R–103

[56] References Cited

U.S. PATENT DOCUMENTS

| | | | |
|---|---|---|---|
| 1,757,464 | 5/1960 | Melick | 194/97 R |
| 2,539,855 | 1/1951 | Nelson | 194/97 R |
| 2,627,961 | 2/1953 | Burnside | 194/97 R |
| 2,932,374 | 4/1960 | Nicolaus | 194/97 R |

*Primary Examiner*—Allen N. Knowles

*Attorney, Agent, or Firm*—Davis, Hoxie, Faithfull & Hapgood

[57] ABSTRACT

A coin testing apparatus includes a coin passageway and means for examining the authenticity of a coin. A thread-catching device is located in the passageway on the inside of a bend in the coin path and upstream of the coin-examining means. The thread-catching device comprises a resilient member which is secured against a part of the wall of the passageway. The resilient member includes a thread-holding portion which lies against the said wall and an entry portion adjacent the thread-holding portion which is spaced from the wall and diverges from the wall towards the edge of the outer catching device.

19 Claims, 9 Drawing Figures

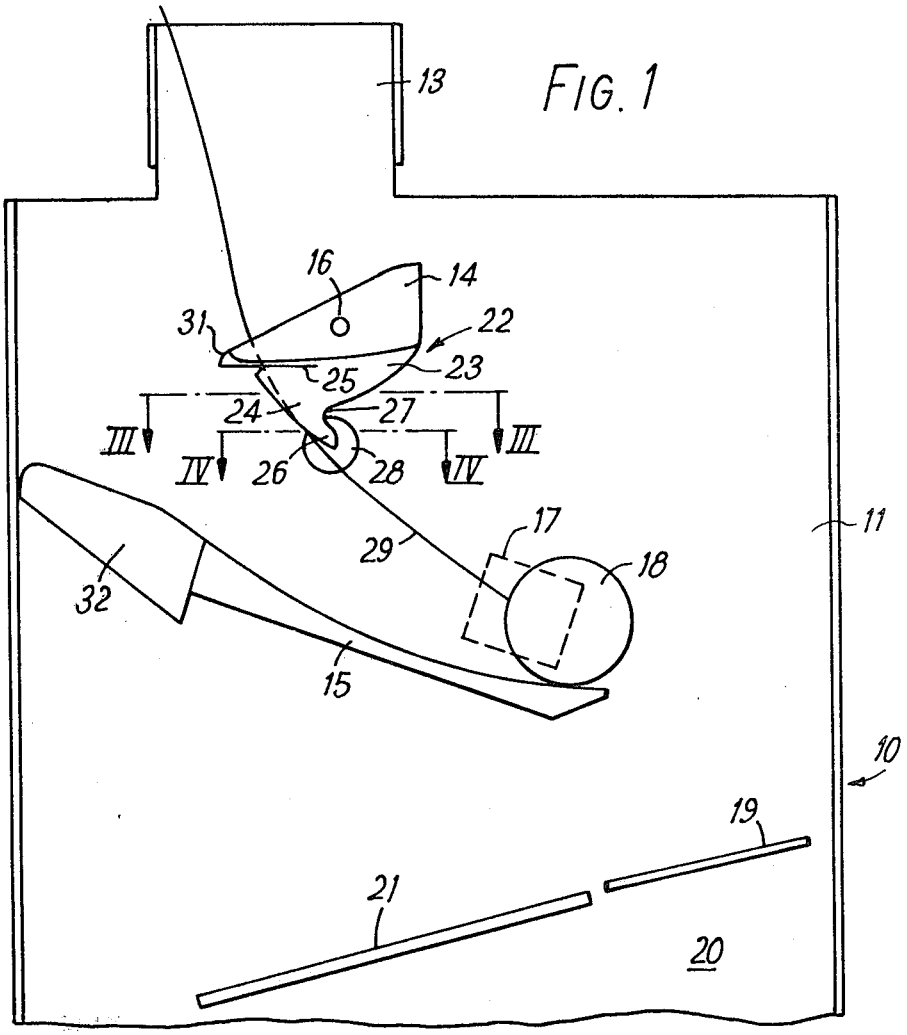
FIG. 1
FIG. 2
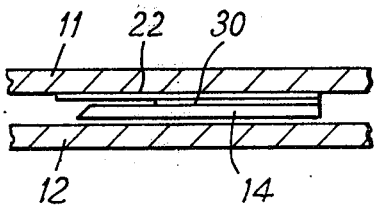
FIG. 3
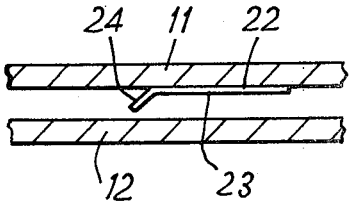
FIG. 4
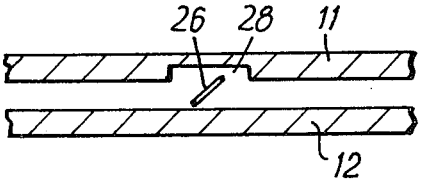

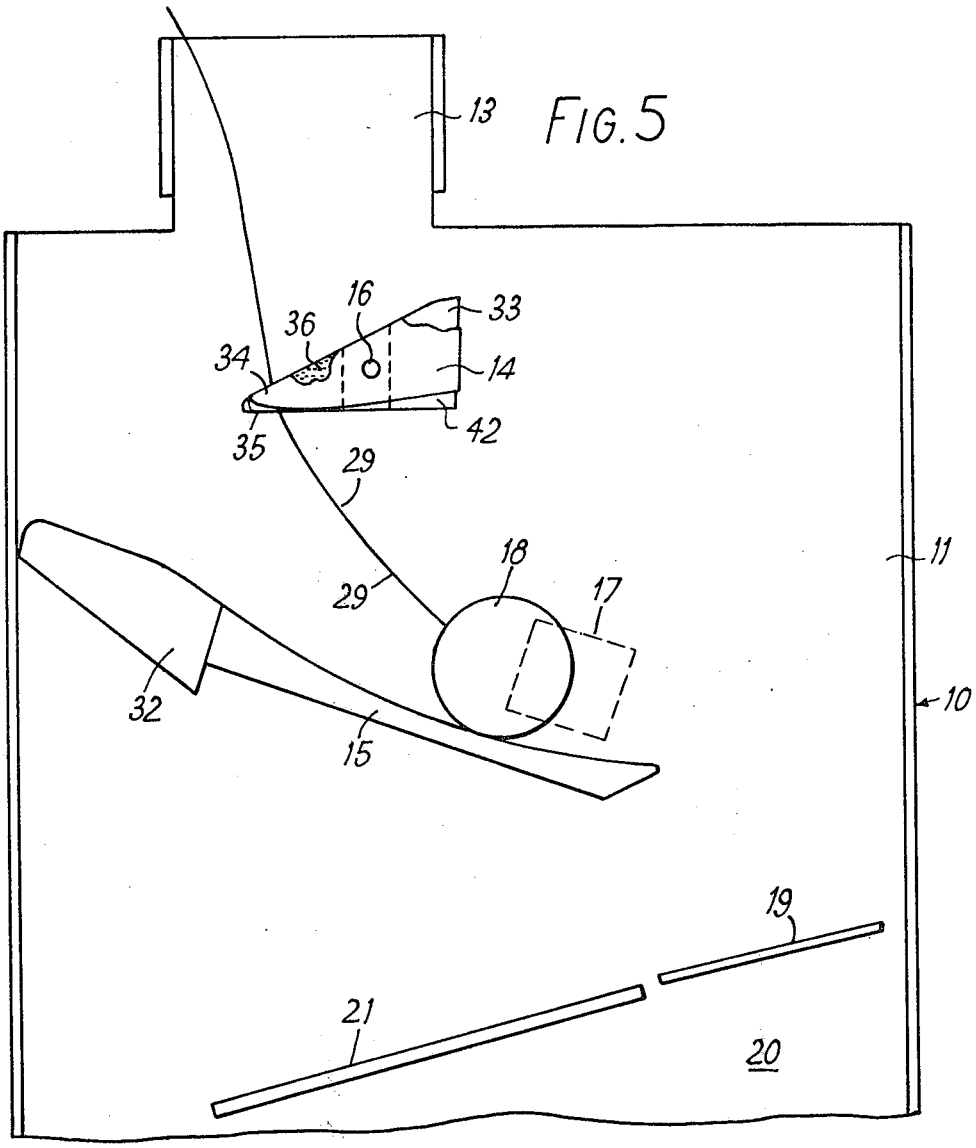
FIG. 5
FIG. 6
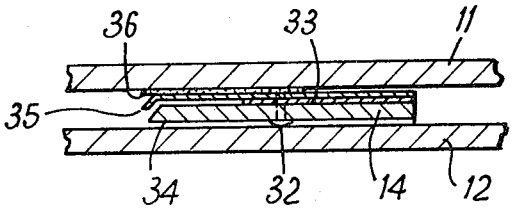

COIN TESTING MECHANISMS

The present invention relates to coin-testing mechanisms, particularly but not exclusively electronic coin-testing mechanisms, and is concerned with a device for preventing a user operating a coin-testing mechanism fraudulently by inserting a coin attached to a piece of thread or line into the mechanism.

In a usual electronic coin-testing mechanism a coin which is inserted into the mechanism moves under gravity down a coin passageway following a meandering path. As the coin moves down the passageway it undergoes tests for authenticity and denomination, sensors being located in the wall of the passageway for providing the signals which are used in the tests as the coin passes. On passing the sensors, an authentic coin of an acceptable denomination will cause the testing mechanism to give an acceptance signal, opening a gate which leads to the coin acceptance box. By inserting a coin on a piece of thread or line it is possible to arrest the movement of the coin down the passageway once it has passed the sensors and the acceptance signal has been given. The coin can then either be drawn back up the passageway and retrieved or be moved back and forth past the sensors so that the single coin produces as many acceptance signals as desired.

According to the present invention a coin-testing mechanism includes a coin passageway defining a coin path along which a coin inserted into the mechanism will travel, means for examining the authenticity of a coin in the passageway and producing an acceptance signal if the coin is found to be acceptable, and a thread-catching device located in the passageway to the inside of a bend in the coin path, upstream of the position a coin reaches when the acceptance signal is first given, so that if a coin attached to a piece of thread or line is inserted into the mechanism, the thread or line is caught by the thread catching device before the coin has reached the said position, the thread-catching device comprising a resilient member which is secured against a part of the wall of the passageway and including a free thread-holding portion lying against the wall and an entry portion adjacent the thread holding portion which diverges from the wall towards the edge of the catching device that faces towards the outside of the said bend, so that when the thread or line is drawn tight as the coin moves towards the said position the thread or line first enters between the entry portion and the wall and is then trapped between the thread-holding portion and the wall. The said part of the wall may be a part of the surface of the plate which defines the coin passageway or it may be a shim or other member secured to such a plate.

In the preferred embodiment the resilient member is a metal plate, for example, a spring sheet plate.

In one form of the invention of the present application the surface of the wall against which the resilient member traps the thread has a high coefficient of friction. It may for example comprise a piece of emery paper secured to the plate that forms the main part of the wall of the passageway.

In another form of the invention the resilient member has a slit extending from its free outer edge, the entry portion and the thread-holding portion being situated to one side of the slit, and another portion which lies against the wall of the passageway being situated to the other side of the slit. Thus a piece of thread which enters between the entry portion and the wall enters the slit, the slit being sufficiently narrow to chafe the thread as it is drawn through the slit. The slit may be provided in addition to or as an alternative to the surface of high friction.

The thread catching device may also include a non-return trap behind which the thread or line passes as the coin moves down the passageway and from which it cannot be removed. In one form a part defining the inside of the bend in the coin path is so arranged that a piece of thread can enter between the said part and the plate defining a wall of the passageway but a coin cannot, and a tang or barb extends across the space which the thread enters, the tip of the tang or barb pointing further into the space which the cotton enters so that if a coin on a thread is inserted into the mechanism when the coin has passed around the bend in the coin path the thread enters between the said part and the said wall and passes around the barb, to a position where it cannot be drawn back around the barb into the coin path.

A recess may be provided in the plate opposite the tang or barb to accommodate the tip of the tang or barb, or a shim may be placed between the resilient member and the plate with a cut-out portion to form a recess which accommodates the tang or barb. The tang or barb may be formed by forming a slit in the upper edge of the resilient member running from the upper edge towards the outer end of the resilient member, and bending a part of the member between the slit and the upper edge towards the said plate.

A second slit may be provided in the resilient member, running from the upper edge away from the outer end of the resilient member and a part of the resilient member between the second slit is bent towards the said plate. Thus if the upper end of the thread is pulled towards the outside of the bend in an attempt to retrieve the coin the thread will enter the first slit and be cut by it and if the upper end of the thread is pulled towards the inside of the bend the thread will enter the second slit and be cut by it.

Alternatively the downstream end of the entry portion may project downstream to form a nose above which on the downstream side of the resilient member is a recess, so that when the string is drawn upwards the point of attachment of the thread to the coin is drawn into the recess. The edge of the nose closest to the side wall may be sent back behind the general plane of the wall and the wall may have a recess to provide clearance around the nose. With this arrangement, when the thread is drawn tight the thread will pass behind the thread-holding portion and behind the nose but a subsequent attempt to move the thread from behind the thread-holding portion will cause the thread to pass in front of the nose, thus preventing the thread from leaving the recess above the nose.

Embodiments of the invention will now be described, by way of example, with reference to the accompanying drawings, of which:

FIG. 1 shows a diagrammatic side elevation of a first coin testing mechanism;

FIG. 2 shows a fragmentary plan view of the mechanism of FIG. 1;

FIG. 3 shows a fragmentary horizontal section on the line III—III of FIG. 1;

FIG. 4 shows a fragmentary horizontal section on the line IV—IV of FIG. 1;

FIG. 5 shows a diagrammatic side elevation of a second coin testing mechanism;

FIG. 6 shows a fragmentary plan view of the mechanism of FIG. 5;

Figure 7:
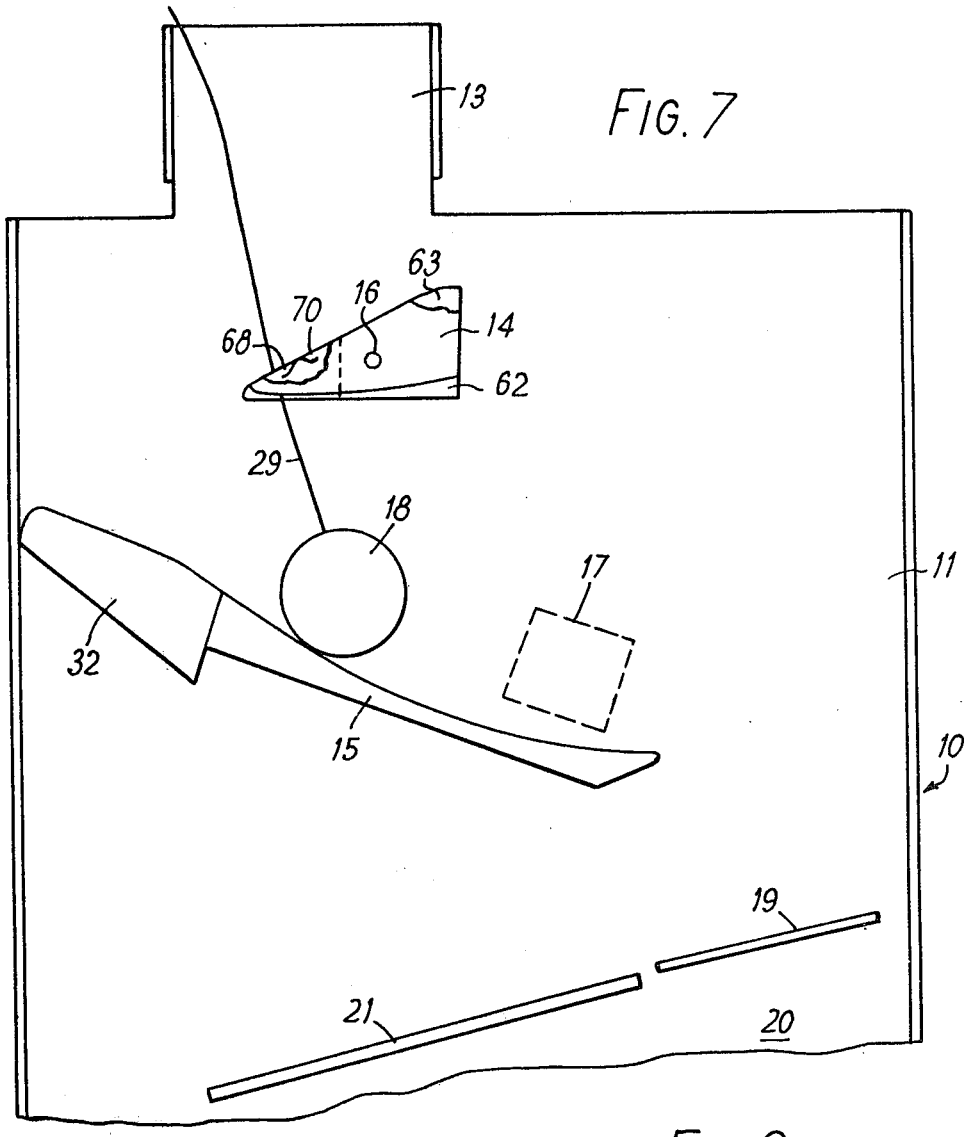
FIG. 7 shows a diagrammatic side elevation of a third coin testing mechanism.

Referring to the FIGS. 1 to 4 of the drawings, a coin testing mechanism 10 has a coin passageway formed between two parallel plates 11 and 12 which are spaced apart by a distance at least as great as the thickness of the thickest coin the mechanism is intended to accept. The plates may be tilted slightly from the vertical towards the front so that the face of a coin moving down the passageway under gravity bears against the front plate 12. At the top of the mechanism is a hopper 13 through which coins enter the mechanism.

Below the hopper 13 is an energy dissipating device or snubber 14 which absorbs the kinetic energy of a coin falling into the mechanism through the hopper 13. The snubber 14 has an upper surface which slopes downwardly towards the left as shown in FIG. 1 and diverts the coins onto a second snubber 32 which is located at the upper end of an inclined coin track 15 mounted on the rear plate 11. The snubbers 14 and 32 may comprise solid blocks of sintered aluminum oxide such as are described in U.S. Pat. No. 3,944,038. The snubber 14 is secured to the rear plate 11 by a screw 16.

The upper surface of the snubber 32 and the coin track 15 are inclined downwardly from left to right and coins inserted into the device roll down the snubber 32 and the track under gravity. Alongside the track mounted in the front plate 12 are coin presence sensors which may be photo-electric sensors or inductive sensors such as are described in our U.S. Pat. No. 1,397,083. The sensors are indicated generally by the reference numeral 17. The sensors form part of a coin examining circuit which tests the coins for authenticity and denomination and gives an acceptance signal if the coin inserted into the mechanism is found to be an authentic coin of one of the denominations of coins which the mechanism is programmed to accept. By the time the coin reaches the position indicated at 18 the coin examining circuits will have determined whether the coin is acceptable or not, and if acceptable they will have issued the appropriate acceptance signal.

Below the lower end of the coin track 15 is an acceptance gate 19. The acceptance gate 19 projects into the coin passageway through a slot in the rear plate 11. If the coin examining circuit issues the acceptance signal, the acceptance signal operates a solenoid (not shown) causing the acceptance gate 19 to be retracted into the plate. Below the acceptance gate 19 is a chute 20 leading to a coin acceptance box which retains accepted coins in the mechanism or to the vending machine cash box.

The upper surface of the coin acceptance gate 19 slopes downwardly from right to left and is aligned with a reject coin track 21. If the coin examining circuit finds the inserted coin to be unacceptable the acceptance gate is not retracted and therefore intercepts the coin falling from the lower end of the track 15. The upper surface of the acceptance gate directs the coin onto the reject coin track 21 which returns the coin to the customer.

Immediately below the snubber 14 at the position where there is a bend in the coin path as the coin is directed first by the snubber 14 onto the snubber 32 and the track 15 and then by the track 15 to pass below the snubber, is a thread catching device 22. The thread-catching device is located to the inside of this bend. It comprises a resilient plate of spring steel the upper part of which is secured between the snubber block and the rear wall of the coin passageway formed by the rear plate 11. A piece of packing material 30 is placed between the catching device and the snubber to space the snubber from the device. The screw 16 passes through the snubber, packing and the catching device clamping them in position.

The part of the catching device 22 immediately below the snubber 14 lies in contact with the rear wall of the passageway but is free to be flexed away from it. This part constitutes a thread-holding portion 23. At the lower side of the catching device facing towards the outside of the bend is an entry portion 24 which is bent to make an obtuse angle with the thread holding portion 23, so that the entry portion diverges from the rear wall of the passageway towards the free outer edge of the catching device.

At the upper upstream end of the entry portion, extending horizontally from the free edge of the catching device, is a narrow slit 25. The part 31 of the catching device above the slit lies flat against the rear wall of the passageway, the lower side of the slit is provided on the part closest the coin path by the entry portion 24 away from the rear wall and on the part remote from the coin path by the thread-holding portion 23.

At the downstream end the entry portion 24 projects beyond the adjacent part of the thread-holding portion 23 to form a nose 26. The nose is inclined to the thread-holding portion and to the rear wall of the passageway at the same angle as the rest of the entry portion. Above the nose 26 on the downstream side of the catching device is formed a recess 27.

The rear edge of the nose 26, that is the edge closest to the rear plate, is set behind the general plane of the rear wall of the passageway. To provide a clearance around the rear edge of the nose there is a circular recess 28 in the rear wall in the vicinity of the nose 26.

The thread-catching device functions as follows. If an authentic coin of an acceptable denomination, attached to a piece of thread 29, is inserted into the passageway and allowed to travel down the passageway to the position 18 where it causes an acceptance signal to be produced by the coin examining circuit and further movement of the coin down the passageway is arrested by pulling of the thread, the thread will be pulled to the inside of the bend in the coin path around the snubber 14. The left hand end of the snubber slopes towards the rear wall as can be seen in FIG. 2 so that the thread enters between the snubber 14 and the upper part 31 of the catching device into the space provided by the packing 30. Further pulling on the thread causes it to enter between the entry portion of the catching device and the rear wall of the passageway and to enter the slit 25, the thread passing in front of the upper part 31 and behind the entry portion 24. As the thread moves further into the slit 25 it passes between the flat thread holding portion 23 and the rear wall of the passageway. The spring steel catching device, because of its resilience, grips the thread against the rear wall so that if the tension on the upper end of the thread is released at this stage the thread-catching device will not release the lower part of the thread. Further pulling on the thread draws the thread through the slit 25. The edges of the slit chafe the thread as it passes across them, weakening it, and possibly causing it to break. At the same time as the thread moves further behind the catching device, to the right as seen in FIG. 1, it passes behind the nose 26, the inclination of the nose enabling the thread to pass behind its rear edge. Once the thread has passed behind the nose, pulling the coin further up the track by means of the thread will not cause the thread to pass back behind the nose because the rear edge of the nose is set behind the plane of the rear wall and therefore the nose intercepts the thread. The inclination of the nose deflects the thread to the front of the nose. From this position, pulling on the thread will only cause the coin to be raised off the track and pulled up against the catcher until the point of attachment of the thread is drawn up to the recess 27. No amount of jiggling of the thread will cause the coin to pass up the passageway around the snubber.

The embodiment of FIGS. 5 and 6 is similar in many respects to the embodiment of FIGS. 1 to 4 and therefore identical reference numerals have been used for identical parts and those parts will not be described further.

In the vicinity of the snubber 14 at the position where there is a bend in the coin path as the coin is directed first by the snubber 14 onto the snubber 32 and the track 15 and then by the track 15 to pass below the snubber, is a thread catching device 42. The thread-catching device 42 is located to the inside of this bend. It comprises a resilient plate of spring steel which is secured between the snubber block and the rear wall of the coin passageway formed by the rear plate 11. A piece of packing material 33 is placed between the middle and right hand parts of the catching device 42 and the snubber to space the snubber from the device so that the left hand part of the plate can flex towards the snubber. The screw 16 passes through the snubber, packing and the catching device clamping them in position. The left hand end 34 of the snubber 14 is chamfered away from the rear plate 11 and the left hand end 35 of the catching device is bent away from the rear wall around the end 34 of the snubber.

On the part of the wall opposite the left hand portion of the catching device 42 is secured a piece of emery cloth 36 with its rough surface facing towards the free left hand portion of the catching device. The catching device 42 terminates at its lower edge just below the lower edge of the snubber so that there are no sharp edges which might injure a Service Engineer when he is servicing the coin mechanism.

The thread catching device functions as follows. If an authentic coin of an acceptable denomination, attached to a piece of thread 29, is inserted into the passageway and with a view to arresting the movement of the coin after it has reached the position 18 where the acceptance signal is produced and before it reaches the acceptance gate by restraining the movement with the thread 29, the thread will be pulled to the inside of the bend in the coin path around the snubber 14 and caught by the thread catching device before the coin reaches the position 18. The left hand end 35 of the catching device is inclined to the rear wall as can be seen in FIG. 6 so that the thread enters between the left hand end 35 and the emery cloth 36. The spring steel catching device, because of its resilience, grips the thread against the emery cloth on the rear wall and the gripping of the thread prevents further movement of the coin down the passageway.

Figure 8:
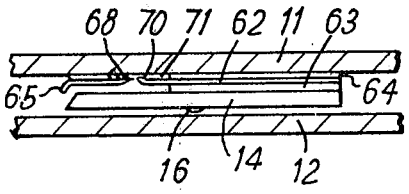
FIG. 8 shows a fragmentary plan view of the mechanism of FIG. 7.
Figure 9:
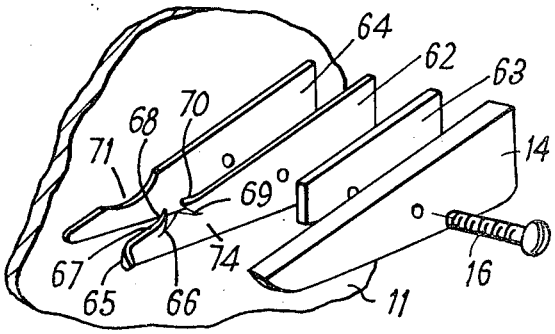
FIG. 9 shows an exploded perspective view of a detail of the mechanism of FIG. 7.

Referring now to FIGS. 7 to 9, these show a testing mechanism similar in many respects to te mechanisms of FIGS. 1 to 4 and FIGS. 5 and 6. The same reference numerals have therefore been used for identical parts.

Behind the snubber 14 at the position where there is a bend in the coin path as the coin is directed first by the snubber 14 onto the snubber 32 and the track 15 and then by the track 15 to pass below the snubber, is a thread-catching device 62. The thread-catching device is located to the inside of this bend. It comprises a resilient plate of spring steel the upper part of which is secured between the snubber block and the rear wall of the coin passageway formed by the rear plate 11. A piece of packing material 63 is placed between the middle right hand parts of the catching device and the snubber to space the left hand end of the snubber from the device. A shim 64 0.010 inch thick of plastics sheet, for example Melinex, is placed between the thread-catching device 62 and the rear wall 11 of the coin passageway. The screw 16 passes through the snubber, packing, the catching device and the shim clamping them in position. The catching device 62 lies in contact with the shim 64 on the rear wall of the passageway but is free at its left hand part 74 to be flexed away from it. The outer end 65 of the left hand entry part is bent away from the rear wall 11. A first slit 66 is formed in the thread catching device running from the upper edge 67 towards the outer end 65. Part of the plate 62 between the slit 66 and the upper edge 67 is bent towards the rear wall to form a tang or barb 68. A second slit 69 is formed in the plate 62 running from the upper end of the slit 66 towards the screw 16. Part of the plate between the slit 69 and the upper edge is bent towards the rear wall to form a second tang or barb 70. A portion of the shim 64 at its upper end is cut out to provide a recess 71 to accommodate the tangs 68 and 70 so that the tips of the tangs lie behind the front face of the shim 64.

The thread-catching device functions as follows. If an authentic coin 18 of an acceptable denomination, attached to a piece of thread 29, is inserted into the passageway andd allowed to travel down the ramp, the thread will be pulled to the inside of the bend in the coin path as the coin passes below the snubber 14. The outer left hand end of the catching device 62 slopes towards the rear wall as can be seen in FIG. 8 so that the thread enters between the free left hand part of the catching device 62 and the shim 64. Any backward pressure on the thread causes it to enter further behind the catching device 62 and past the tang or barb 68 which acts as a non-return trap. The recess 71 provides a clearance for the thread to pass around the tip of the barb 68 from left to right but because the tip lies behind the front plane of the shim, the thread cannot return from right to left. Further movement of the coin down the ramp is prevented as the thread is drawn further under the catching device and is clamped by the device against the shim.

Any attempt to withdraw the coin will, depending upon the direction from which it is pulled, either pull the cotton back into the slit 66 which acts as a cutting edge or towards the tang 70 which directs the thread into the slit 69 which also acts as a cutting edge. In either case the thread is cut and the coin remains held by the remaining portion of thread that is trapped under the catching device.

I claim:

1. A coin-testing apparatus including a passageway defining a path along which a coin inserted into the apparatus will travel; at least one wall defining one side of the passageway; means for examining the authenticity of a coin in the passageway and producing an acceptance signal if the coin is found to be acceptable; a resilient thread-catching device secured against the wall of the passageway to the inside of a bend in the coin path upstream of the position a coin reaches when the acceptance signal is first given, the thread-catching device comprising a thread-holding portion lying adjacent the wall surface but free to be flexed away from it, an entry portion adjoining the thread-holding portion and diverging from the wall towards its free outer end, the thread-holding portion having a protrusion extending toward the wall; and a member having a recess to receive the protrusion so that, when a thread attached to a coin which has moved along the coin path to a position downstream of the thread-catching device is tensioned and pulled upwardly, the tensioned thread will slip behind the entry portion and then into the recess and past the protrusion.

2. An apparatus according to claim 1 in which the said wall is formed by a shim mounted on a plate which defines one side of the coin passageway.

3. An apparatus according to claim 1 in which the resilient member is a flexible plate.

4. An apparatus according to claim 3 in which the flexible plate is of metal.

5. An apparatus according to claim 4 in which the flexible plate is of spring steel.

6. An apparatus according to any of claims 1 in which the surface of the said wall against which the resilient member traps the thread has a high coefficient of friction.

7. An apparatus according to claim 1 in which the resilient member has a slit extending from its free outer edge, the entry portion and the thread-holding portion being situated on one side of the slit, and another portion which lies against the wall of the passageway being situated on the other side of the slit.

8. An apparatus according to claim 1 in which the thread-catching device includes a non-return trap behind which the thread or line passes as the coin moves down the passageway and from which it cannot be removed by pulling the thread or line in the opposite direction.

9. An apparatus according to claim 8 in which the non-return is formed by a part defining the inside of the bend in the coin path which is so arranged that a piece of thread can enter between the said part and the said wall of the passageway but a coin cannot, and the protrusion is a tang or barb extending across the space which the thread enters, the tip of the tang or barb pointing further into the space which the thread enters so that if a coin on a thread or line is inserted into the mechanism when the coin has passed around the bend in the coin path the thread or line enters between the said part and the said wall and passes around the barb to a position where it cannot be drawn back around the barb into the coin path.

10. An apparatus according to claim 9 in which the tang or barb is formed as part of the entry portion of the resilient member bent towards the said plate.

11. An apparatus according to claim 9 in which a recess is provided in the wall opposite the tang to accommodate the tip of the barb or tang.

12. An apparatus according to claim 11 in which the recess is formed by a shim placed between the resilient member and the wall which defines one side of the coin passageway, the shim having a cut-out portion to form the recess which accommodates the tang or barb.

13. An apparatus according to claim 8 in which the tang or barb is formed by forming a slit in the upper edge of the resilient member running from its upper edge towards the outer end of the resilient member and bending a part of the member between the slit and the upper edge, towards the said wall.

14. An apparatus according to claim 13 in which a second slit is provided in the resilient member inwardly of the first slit and running from the upper edge away from the outer end of the resilient member and a part of the resilient member between the slit and the upper edge is bent towards the said wall.

15. An apparatus according to claim 8 in which the non-return trap comprises a nose formed as the protrusion at the downstream end of the entry position, a recess in the resilient member on the downstream side of the resilient member above the nose.

16. An apparatus according to claim 15 in which a recess is provided in the wall opposite the nose and part of the nose projects into the recess.

17. An apparatus according to claim 1 in which the entry portion diverges from the said wall towards the edge of the resilient member that faces towards the outside of the bend in the coin path.

18. A coin-testing apparatus including a passageway having at least one delineating side wall defining a path along which a coin inserted into the apparatus will travel, means for examining the authenticity of a coin in the passageway and producing an acceptance signal if the coin if found to be acceptable, and a resilient thread-catching device secured against the wall of the passageway to the inside of a bend in the coin path and upstream of the position a coin reaches when the acceptance signal is first given, the thread-catching device comprising a thread-holding portion lying adjacent to the wall surface but free to be flexed away from it, and an entry portion adjoining the thread-holding portion and diverging from the wall towards its free outer end; and an abrasive surface between the wall and the thread-holding portion; so that, if a thread attached to a coin which has moved along the coin path to a position downstream of the thread-catching device is tensioned and pulled upwardly, the tensioned thread will slip between the entry portion of the thread-catching device and the wall, and then against the abrasive surface.

19. An apparatus according to claim 18 in which the said surface is provided by a piece of abrasive paper or cloth.

* * * * *

UNITED STATES PATENT AND TRADEMARK OFFICE

CERTIFICATE OF CORRECTION

PATENT NO. : 4,128,157

DATED : December 5, 1978

INVENTOR(S) : Michael I. Henville

It is certified that error appears in the above-identified patent and that said Letters Patent are hereby corrected as shown below:

Col. 6, line 2, "te" should be --the.

Col. 6, line 41, "andd" should be --and--.

Col. 7, claim 6, line 1, delete "any of".

Col. 8, claim 10, line 3, "plate" should be --wall--.

Col. 8, claim 15, line 26, "position" should be --portion--.

Signed and Sealed this

*Eighteenth* Day of *March 1980*

[SEAL]

*Attest:*

SIDNEY A. DIAMOND

*Attesting Officer*

*Commissioner of Patents and Trademarks*